US008550794B2

(12) United States Patent
Du

(10) Patent No.: US 8,550,794 B2
(45) Date of Patent: Oct. 8, 2013

(54) DOUBLE ACTING FLUID PUMP

(75) Inventor: Benjamin R. Du, Newport Coast, CA (US)

(73) Assignee: Foothill Land, LLC, Laguna Niguel, CA (US)

( * ) Notice: Subject to any disclaimer, the term of this patent is extended or adjusted under 35 U.S.C. 154(b) by 460 days.

(21) Appl. No.: 12/852,844

(22) Filed: Aug. 9, 2010

(65) Prior Publication Data

US 2012/0034119 A1 Feb. 9, 2012

(51) Int. Cl.
*F04B 35/04* (2006.01)

(52) U.S. Cl.
USPC ..... 417/418; 417/550; 91/422

(58) Field of Classification Search
USPC ..... 417/417, 418, 550; 91/422
See application file for complete search history.

(56) References Cited

U.S. PATENT DOCUMENTS

| | | | | |
|---|---|---|---|---|
| T946012 | I4 * | 5/1976 | Willis | 417/550 |
| 4,532,685 | A * | 8/1985 | Itoh et al. | 29/888.02 |
| 4,541,450 | A * | 9/1985 | Bron | 137/99 |
| 6,231,310 | B1 * | 5/2001 | Tojo et al. | 417/44.1 |
| 7,465,382 | B2 * | 12/2008 | Paul et al. | 204/600 |
| 2004/0028545 | A1 * | 2/2004 | Wang | 417/550 |
| 2006/0171825 | A1 * | 8/2006 | Choi et al. | 417/417 |
| 2008/0095647 | A1 * | 4/2008 | Grundl et al. | 417/417 |

OTHER PUBLICATIONS

Coast & Alloys, Piston Nomenclature; 2005; www.cast-alloys/products/piston_nomenlature.htm; 1 page.

* cited by examiner

*Primary Examiner* — Devon Kramer
*Assistant Examiner* — Christopher Maxey
(74) *Attorney, Agent, or Firm* — Stetina Brunda Garred & Brucker

(57) ABSTRACT

A double acting dual stroke fluid pump with pressure assists is disclosed. First and second pistons are mounted to a common shaft which reciprocates within first and second cavities during compression and suction strokes. The second piston may have a one way valve which opens and closes during the compression and suction strokes to enable the fluid pump to force fluid out of the outlet during both the compression and suction strokes.

9 Claims, 4 Drawing Sheets

DOUBLE ACTING FLUID PUMP

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a fluid pump.

A prior art fluid pump 10 is shown in FIGS. 1-3. FIG. 1 illustrates the prior art fluid pump 10 which includes a solenoid 12, a spring 14, and a piston 16 within a cylinder 18. Intake and output valves 20, 22 are located on the cylinder 18 which pumps fluid (e.g., liquid and gas) out of the pump 10. During the compression stroke shown in FIG. 1, the solenoid 12 is de-energized and the spring 14 traverses the piston 16 in the direction of arrow 17. Fluid is forced out of the output valve 22. At the end of the compression stroke, the solenoid 12 is energized so as to overcome the force of the spring 14 and retract the piston 16 in the direction of arrow 19 as shown in FIG. 2. Retraction of the piston 16 enlarges the pumping chamber 24 and draws fluid into the pumping chamber 24 through the intake valve 20. No fluid flows out of the output valve 22 during the suction stroke. At the end of the suction stroke, as shown in FIG. 3, the spring 14 is compressed. When the solenoid 12 is de-energized, the spring 14 decompresses and initiates the compression stroke pumping fluid out of the output valve 22 as shown in FIG. 1. The cycle repeats to pump fluid out of the fluid pump.

The solenoid 12 is energized to effectuate the suction stroke and de-energized to allow the spring 14 to effectuate the compression stroke. This cycle is repeated to draw fluid into the pumping chamber 24 and pump fluid out of the fluid pump 10. For one half of the travel of the piston 16, namely, the suction stroke, no fluid is pumped out of the fluid pump 10. Fluid is only pumped out of the fluid pump 10 during the compression stroke. As a result, the fluid flow requirement of the fluid pump 10 must be designed into the compression stroke. If more fluid flow is desired then the stroke of the piston 16 must be increased or the area of the piston 16 must be enlarged to increase the linear volumetric displacement of the piston 16 during the compression stroke. Unfortunately, these adjustments produce large spikes in fluid pressure at the output valve 22 since fluid flows out of the fluid pump only during the compression stroke. Alternatively, to increase the fluid flow rate, the cycles per minute of the piston 16 may be increased. Unfortunately, this adjustment increases undesirable vibration and noise.

Accordingly, there is a need in the art for an improved fluid pump.

BRIEF SUMMARY

An improved fluid pump shown and described herein addresses the needs described above, described below and those that are known in the art.

The fluid pump has first and second pistons that are fixedly attached to a common shaft. The first and second pistons are of different sizes so that its volumetric linear displacement is different. In the example shown herein, the first piston is smaller than the second piston so that for every incremental linear displacement of the first piston, a smaller volume is displaced in comparison to the volumetric displacement of the second piston. During operation of the fluid pump, a secondary chamber decreases during a suction stroke thereby pumping fluid out of an outlet of the fluid pump. During a compression stroke, the volume of the secondary chamber increases. Nonetheless, fluid is pumped out of the outlet. The way that this is accomplished is by incorporating a one-way valve in the second piston. During the compression stroke, the one-way valve is opened to provide fluid communication between the secondary chamber and a pumping chamber. Although the volume of the secondary chamber increases during the compression stroke, the cumulative volume of the secondary chamber and the pumping chamber decreases to pump fluid out of the pump. The volumes of the secondary and pumping chambers are cumulated since the one-way valve is open and provides fluid communication therebetween. Hence, during the compression stroke, fluid is pumped out of the pump. The pump pumps fluid during both the compression and suction strokes. Since fluid is pumped out of the pump during both the compression and suction strokes, fluid flow rate at the output of the pump may be spread over a longer period of time which provides for lower maximum pressure spikes at the output valve compared to prior art pumps which discharge fluid only during the compression stroke.

Moreover, the compression and suction strokes may be aided by fluid pressure. In particular, the outlet of the fluid pump may always be pressurized. This places positive pressure in the secondary chamber. When the one-way valve disposed on the second piston is in the closed position, the fluid pressure applies a force on the second piston as well as on the first piston. However, since the second piston is larger than the first piston (i.e., larger surface area), the net bias force due to fluid pressure provides a fluid pressure bias force to initiate the compression stroke. As the compression stroke progresses, the pressure within the pumping chamber increases which ultimately opens up the one-way valve on the second piston. The fluid pressure does not create a force on the second piston at this time. Nonetheless, when the one-way valve opens up, the first piston is sufficiently disposed within the solenoid so that the power of the solenoid can drive the rest of the compression stroke without the fluid pressure bias force. At the end of the compression stroke, the pumping chamber is slightly pressurized which aids in initiating the suction stroke. Additionally, the pressure at the outlet of the fluid pump may aid in suction stroke. In particular, the pressure at the outlet of the fluid pump acts on the second piston since the one way valve is closed at this point. The fluid pressure produces a fluid pressure bias force on the second piston. The spring must overcome this fluid pressure bias force acting on the second piston. Fortunately, the pressure at the outlet of the fluid pump is also applied to the first piston and produces a fluid pressure bias force on the first piston in the opposite direction. This fluid pressure bias force on the first piston counteracts the fluid pressure bias force on the second piston so that a weaker spring may be utilized. The spring is aided by the fluid pressure applied to the first piston to overcome the fluid pressure bias force on the second piston. A smaller spring also allows use of a weaker solenoid to drive the suction stroke. Fluid pressure at the pump outlet is used to assist the compression and suction strokes to reduce the size requirements of the solenoid and spring. Weaker springs and solenoids may be used which reduces the operating temperature of the fluid pump and reduces the noise and vibration of the fluid pump.

More particularly, an improved fluid pump is disclosed. The improved fluid pump may include a housing, first piston and second piston. The housing may define a first cavity and a second cavity in fluid communication with the first cavity. A linear volumetric displacement of the first cavity may be smaller than a linear volumetric displacement of the second cavity. The housing may have an outlet for discharging fluid out of the outlet.

The first and second pistons may be fixedly mounted to a shaft. The first piston may be slideably seated within the first cavity. The second piston may be slideably seated within the second cavity. The first and second pistons may collectively define a secondary chamber which increases and decreases during reciprocal movement. The outlet may be in fluid communication with the secondary chamber. The first and second pistons are traversable between a compression stroke and suction stroke for respectively enlarging and reducing a volume of the pumping chamber. The second piston may have a one-way valve for flowing fluid from a pumping chamber to the secondary chamber during the compression stroke.

The one-way valve is closed during the suction stroke to discharge fluid out of the outlet and the one-way valve is opened during the compression stroke so that collectively the pumping chamber and the secondary chamber reduces in volume to discharge fluid out of the outlet.

A spring may be mounted to the first and second pistons and an electrical coil mounted to the housing for traversing the first and second pistons in the compression and suction strokes. The electrical coil may be disposed about the first cavity. The spring may be disposed about the shaft within the first cavity. A diameter of the first piston may be smaller than a diameter of the second piston. The outlet may be in fluid communication with the secondary chamber.

The pump may be a compressor for displacing or pumping gas (e.g., air, etc.). Alternatively, the pump may displace or pump liquid such as oil, water, etc.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

As used herein, the term "pump" refers to a device that displaces or pumps liquid or gas. Additionally, as used herein, the term "fluid" refers to liquid or gas such as air.

Figure 1:
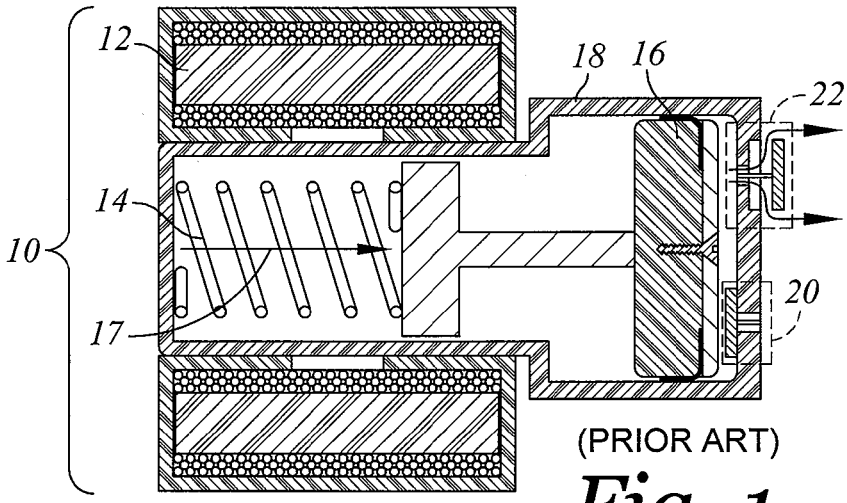
(PRIOR ART) Fig. 1
FIG. 1 is a cross sectional view of a prior art fluid pump during a compression stroke.
Figure 2:
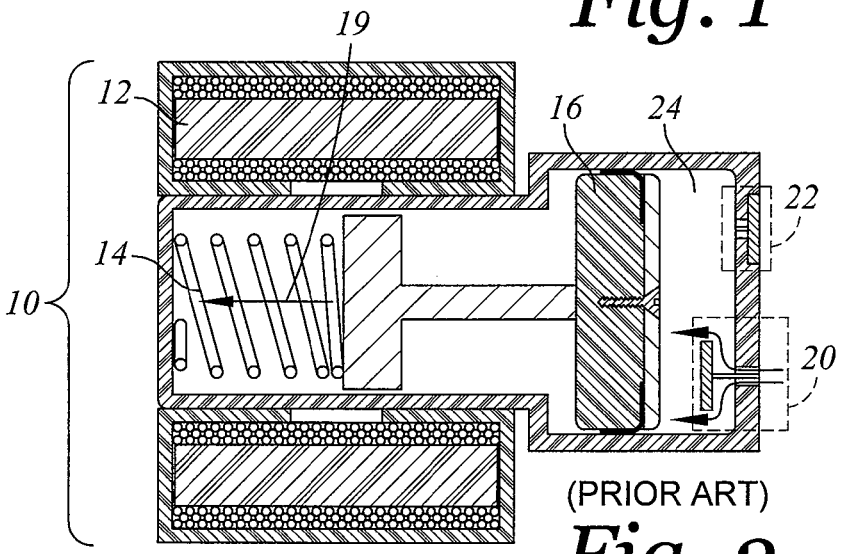
(PRIOR ART) Fig. 2
FIG. 2 is a cross sectional view of the prior art fluid pump shown in FIG. 1 during a suction stroke.
Figure 3:
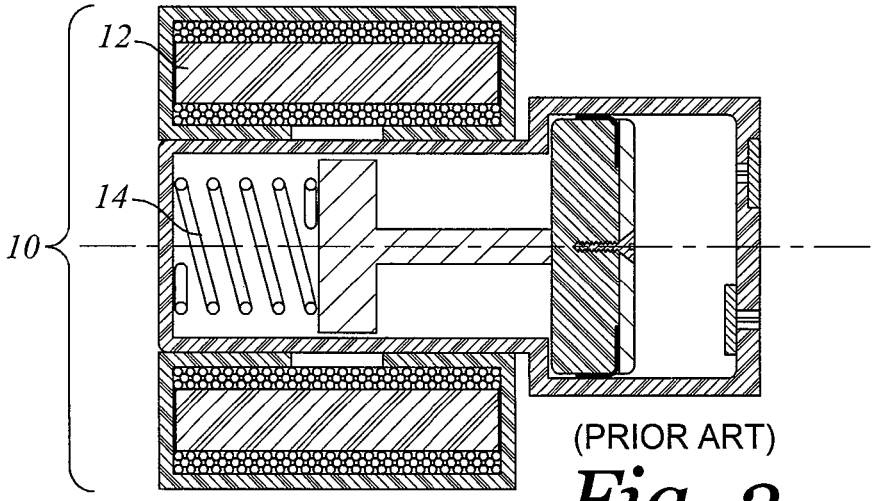
(PRIOR ART) Fig. 3
FIG. 3 is a cross sectional view of the prior art fluid pump shown in FIG. 2 at the end of the suction stroke.
Figure 4:
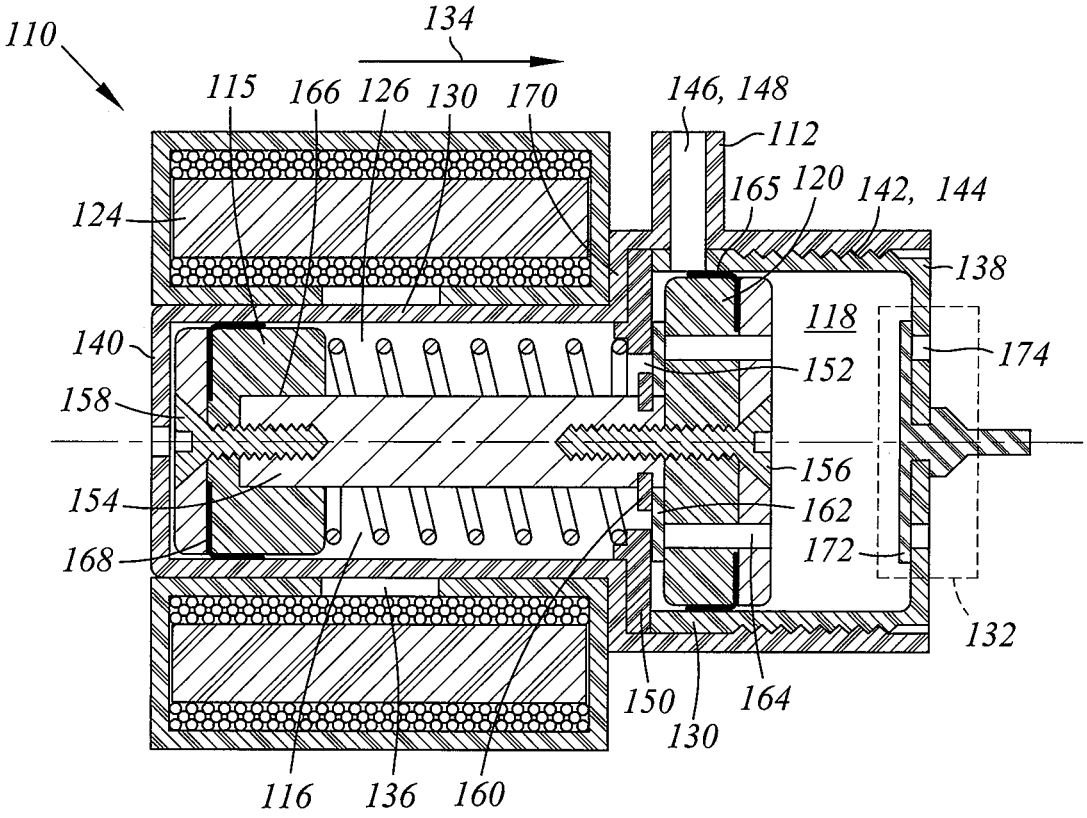
FIG. 4 is a cross sectional view of an improved fluid pump.
Figure 5:
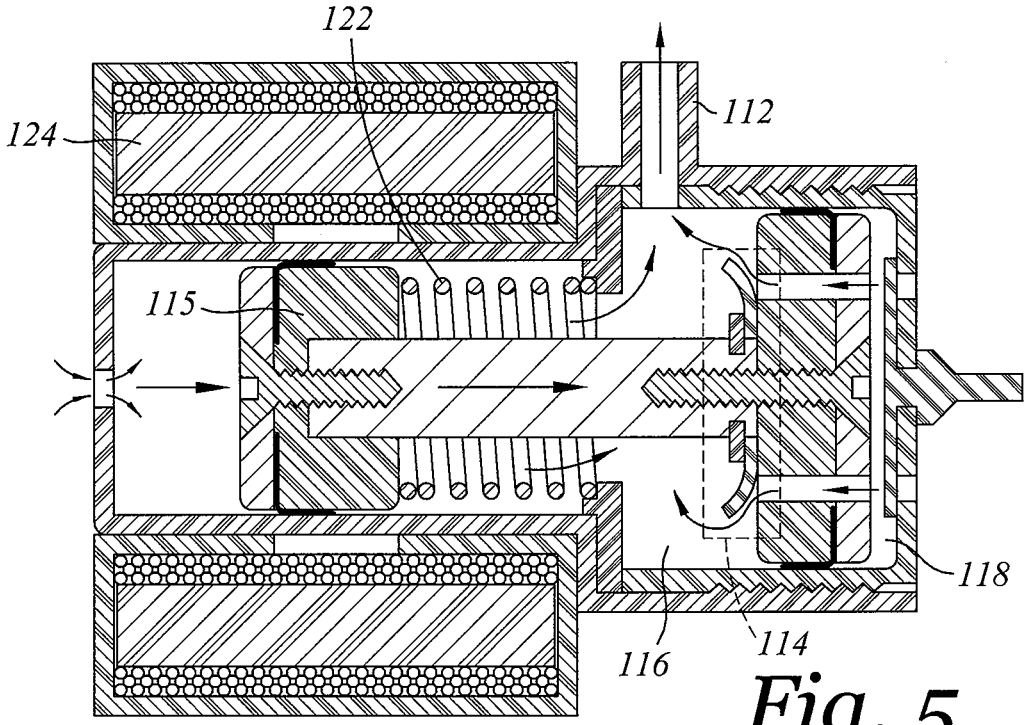
FIG. 5 is a cross sectional view of the improved fluid pump during a compression stroke.
Figure 6:
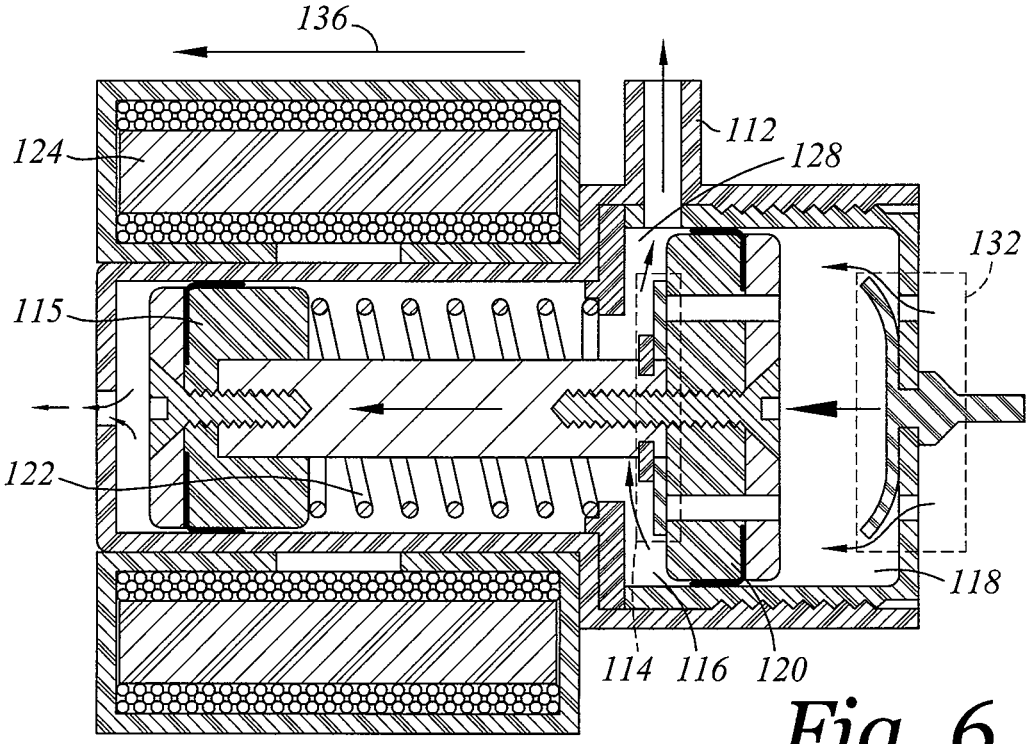
FIG. 6 is a cross sectional view of the improved fluid pump during a suction stroke.

Referring now to FIGS. 4-6, a double acting dual stroke fluid pump 110 is shown. The pump 110 pumps fluid out of an outlet 112 during a compression stroke shown in FIG. 5 as well as during a suction stroke shown in FIG. 6. During the compression stroke, a one-way valve 114 is opened so that as a first piston 116 (see FIG. 5) is displaced, the cumulative volume of a secondary chamber 116 and a pumping chamber 118 is reduced thereby pumping fluid out of outlet 112. During the suction stroke shown in FIG. 6, the one-way valve 114 is closed isolating the secondary chamber 116 from the pumping chamber 118 so that the volume of the secondary chamber 116 is reduced thereby pumping fluid out of the outlet 112. The fluid pump 110 discharges fluid during both the compression and suction strokes so that a more even flow of fluid is discharged out of the fluid pump 110 with a lower maximum fluid pressure spike compared to prior art fluid pumps.

Moreover, the outlet 112 may have a constant positive pressure which is above atmospheric pressure. Accordingly, the secondary chamber 116 is always pressurized. At the start of the compression stroke, the piston 120 is at the position shown in FIG. 4. The constant fluid pressure in the secondary chamber 116 helps to initiate the compression stroke. The second piston 120 is larger than the first piston 115. As such, the fluid pressure produces a greater force on the second piston 120 than the first piston 115. This helps to initiate the compression stroke. The solenoid 124 does not need to do all of the work to initiate the compression stroke. A smaller solenoid can be utilized. The smaller solenoid takes up less power and produces less heat and vibration.

The fluid pressure in the secondary chamber 116 also assists the spring 122 in driving the suction stroke shown in FIG. 6. The second piston 120 is traversed in the direction shown in FIG. 6 during the suction stroke. The fluid pressure at the outlet 112 provides a bias force to the second piston 120 in the opposite direction from the desired travel direction of the second piston 120 during the suction stroke. In prior art fluid pumps, only the spring 122 overcomes this fluid bias force applied to the second piston 120. Fortunately, the fluid pressure at the outlet 112 is also applied to the first piston 115 which produces an opposite fluid bias force to the fluid bias force applied to the second piston 120. The fluid pressure bias force on the first piston 115 counteracts the bias force of the fluid pressure on the second piston 120 so that a smaller spring 122 can be used. The smaller spring 122 also enables use of a smaller solenoid 124 which must overcome the spring force during the compression stroke. The smaller spring and smaller solenoid allows the fluid pump to run cooler and produce less noise and vibration compared to prior art fluid pumps.

Referring now more particularly to FIG. 4, the fluid pump 110 may have a secondary chamber 116 and a pumping chamber 118 which are on opposed sides of the second piston 120. The first piston 115 which is fixedly attached to the second piston 120 by way of a shaft 54 is slidably seated on the housing wall 130 so as to provide a substantially fluid tight seal between the first piston 115 and the housing wall 130. The second piston 120 may also be slidably seated on the housing wall 130 so that a substantially fluid tight seal is formed between the second piston 120 and the housing wall 130. The volume of the secondary chamber 116 and the pumping chamber 118 increase and decrease when cycling between the compression and suction strokes. When the solenoid 124 is de-energized, the first and second pistons 115, 120 may be in the position shown in FIG. 4. The one-way valve 114 and the one-way valve 132 are in the closed position. The outlet 112 may have pressurized fluid which provides positive pressure to the secondary chamber 116. The pressurized fluid applies a force to the first and second pistons 115, 120. The force on the second piston 120 is greater than the force on the first piston 115 since the second piston 120 is larger than the first piston 115. The larger surface area of the second piston 120 provides a net force to the first and second pistons 115, 120 that bias the pistons 115, 120 to the right as shown by arrow 134 in FIG. 4. The net force aids the solenoid in driving the compression stroke. As such, a smaller solenoid 124 may be used so that the fluid pump produces less heat, vibration and noise. When the solenoid 124 is energized, the solenoid 124 along with the net fluid bias force acting on the first and second pistons 115, 120 due to pressure at the outlet 112 drives the second piston 120 to the right as shown by arrow 134 toward the gap 136.

There is a one-way valve 114 incorporated into the second piston 120. As long as the one-way valve 132 remains closed, the secondary chamber 116 is isolated from the pumping chamber 118 and the net fluid bias force assists in driving the first and second pistons 115, 120 in the compression stroke. When the one way valve 114 is open, fluid can travel from the pumping chamber 118 to the secondary chamber 116. When the one way valve 114 is open, the cumulative volume of the secondary chamber 116 and the pumping chamber 118 decreases during the compression stroke to pump fluid out of the fluid pump 110. The housing wall 130 may additionally have a one-way valve 132 that allows fluid (e.g., atmospheric fluid) to enter the pumping chamber 118 during the suction stroke (see FIG. 6).

As the compression stroke progresses, the pressure within the pumping chamber 118 increases or rises from atmospheric pressure to above atmospheric pressure until it reaches and exceeds the pressure within the secondary chamber 116. At that time, the one-way valve 114 opens, as shown in FIG. 5. The positive fluid pressure at the outlet 112 no longer provides a net fluid bias force in the direction of arrow 134. However, the first piston 115 is sufficiently disposed within the solenoid 124 so that power from the solenoid 124 is sufficient to drive or complete the compression stroke. Since the one-way valve 114 is opened, further movement of the first and second pistons 115, 120 to the right reduces the cumulative volume of the secondary chamber 116 and the pumping chamber 118. Hence, the fluid within the secondary chamber 116 is pumped out of the outlet 112 during the compression stroke.

After completion of the compression stroke, the solenoid 124 is de-energized. The spring 122 pushes the first piston 115 to the left as shown by arrow 136, as shown in FIG. 6. Additionally, at the completion of the compression stroke, the one-way valve 114 is now closed and the pumping chamber 118 is slightly pressurized. The pressure within the pumping chamber 118 provides assistance in initiating the suction stroke. Moreover, the positive pressure of the outlet 112 places a force on the second piston 120 which must be overcome by the spring 122. Fortunately, the fluid pressure at the outlet 112 is also applied to the first piston 115 counteracting the fluid bias force on the second piston 120. The pressure in the pumping chamber 118 and the reduction of the force acting on the second piston 120 due to the fluid pressure at outlet 112 on the first piston 115 reduces the solenoid 124 and spring 122 size requirements. A smaller spring 122 and a weaker solenoid 124 may be used which allows for a fluid pump 110 that produces less heat, vibration and noise.

The spring 122 traverses the first and second pistons 115, 120 to the left. As the first and second pistons 115, 120 travel to the left, the secondary chamber 116 is reduced in volume since the one way valve 114 is closed and the secondary chamber 116 is isolated from the pumping chamber 118. Fluid is pumped out of the outlet 112 of the fluid pump 110. During the suction stroke, the pressure within the pumping chamber 118 drops below atmospheric pressure thereby opening the one-way valve 132 to allow fluid into the pumping chamber 118 from outside the fluid pump.

The fluid pump 110 discharges fluid out of the fluid pump 110 during both the compression stroke and the suction stroke. The fluid flow requirements of the fluid pump 110 can be spread over both the compression stroke and the suction stroke and not just over the compression stroke as in prior art fluid pumps. The maximum fluid flow discharge rate can be lower compared to prior art fluid pumps yet maintain the same overall fluid flow discharge rate. The fluid pump 110 is also less noisy and vibrates less compared to prior art fluid pumps having similar fluid flow characteristics.

Figure 7:
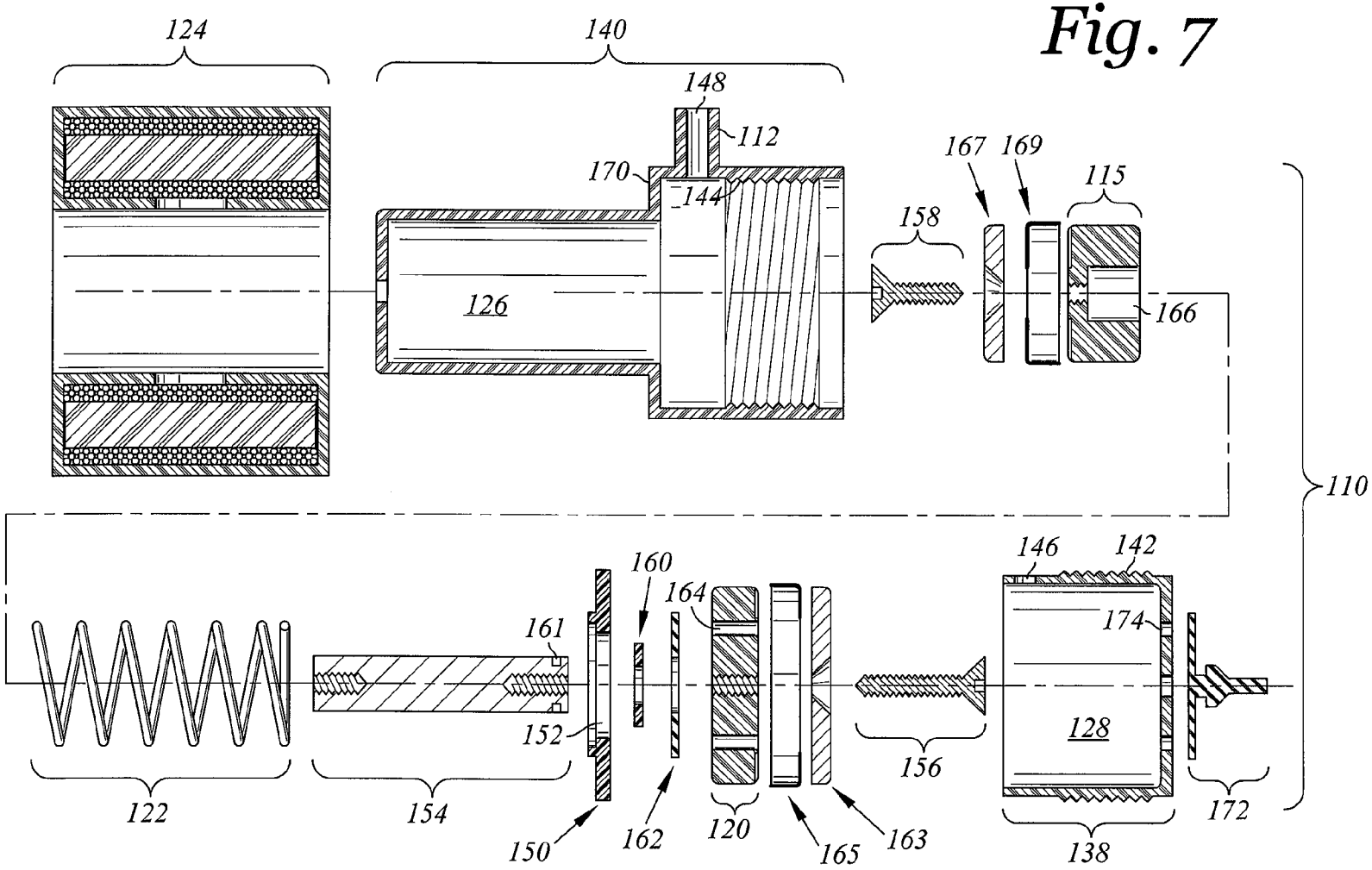
FIG. 7 is an exploded cross sectional view of the improved fluid pump shown in FIG. 4.

Referring now to FIG. 7, the fluid pump 110 may be assembled in the following manner. The fluid pump 110 may comprise inner and outer housings 138, 140. The inner and outer housings 138, 140 may have threads 142, 144 wherein the inner housing 138 may be threaded onto or within the outer housing 148 and cinched down to secure the inner housing 138 to the outer housing 140. The inner and outer housings 138, 140 may also have apertures 146, 148 defined by the outlet 112. The apertures 146, 148 may be aligned to each other to define an internal passageway of the outlet 112. The inner and outer housings 138, 140 may have a generally cylindrical configuration to receive first and second pistons 115, 120 which may also have corresponding cylindrical shapes. The inner housing 138 may have a cap 150. The cap 150 may have an aperture 152.

To begin assembly of the fluid pump 110, a shaft 154, which fixes the first and second pistons 115, 120 to each other, is inserted through the aperture 152. A rigid o-ring 160 may be secured to the shaft 154 at groove 161. A flex-o-ring ring 162 may be interposed between the o-ring 160 and the second piston 120. The second piston 120 may be placed over a distal end of the shaft 154 and attached to the distal end by way of screw 156. The screw 156 attaches a cap 163 and seal 165 to the second piston 120. The spring 122 is disposed over the shaft 154 and seated onto the cap 150. The first piston 115 is pressed over the shaft 154 and attached to the distal end portion of the shaft 154 by way of screw 158. The screw 158 also attaches cap 167 and seal 169 to the first piston 115. At this time, the spring 122 is preloaded so as to bias the first and second pistons 115, 120 in the position shown in FIG. 4. The flex-o-ring 162 may define the one-way valve 114 allowing fluid to travel from the pumping chamber 118 to the secondary chamber 116 as shown in FIG. 5. The fluid travels through fluid holes 164 formed through the second piston 120.

The first piston 115 may have a recess 166 which receives the distal end portion of the shaft 154. Both the first and second pistons 115, 120 may be fitted with seals 165, 169 that form an fluid tight seal with the interior surfaces of the respective inner and outer housings 138, 140.

With the first and second pistons 115, 120 attached to the shaft 154 and mounted to the cap 150, the first piston 115 may be inserted into a first cavity 126 of the outer housing 140. The cap 150 is pushed into the outer housing 140 until the cap 150 bottoms out at the ledge 170. The inner housing 138 may now be threaded onto the outer housing 140. In doing so, the second piston 120 is now seated within a second cavity 128 of the inner housing 138. The apertures 146, 148 of the inner and outer housings 138, 140 are aligned to each other to allow fluid to be pumped out of the outlet 112. Prior to attaching the inner housing 138 to the outer housing 140, the one-way rubber seal 172 may be attached to the inner housing 138 to form the one-way valve 132. Fluid holes 174 provide fluid communication from the atmosphere to the pumping chamber 118. Solenoid 124 is disposed over the outer housing 140.

The improved fluid pump 110 outputs fluid at the outlet 112 during both the compression stroke and the suction stroke. As a result, the pulsation caused by the fluid pump 110 is less than prior art fluid pumps. Also, the rate of fluid output or fluid output is more steady or has less extremes since the improved fluid pump provides one half of the fluid output per each of the compression and suction strokes compared to prior art fluid pumps.

The above description is given by way of example, and not limitation. Given the above disclosure, one skilled in the art could devise variations that are within the scope and spirit of the invention disclosed herein, including various ways of assembling the improved fluid pump 10. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fluid pump comprising:

a housing defining a first cavity and a second cavity in fluid communication with the first cavity, a linear volumetric displacement of the first cavity being smaller than a linear volumetric displacement of the second cavity, the housing having an outlet for discharging fluid out of a secondary chamber;

first and second pistons fixedly mounted to a solid shaft, the first piston slideably seated within the first cavity, the second piston slideably seated within the second cavity, the first piston, second piston and the housing collectively defining the secondary chamber which increases during a compression stroke and decreases during a suction stroke, the outlet being in fluid communication with the secondary chamber, the second piston is traversable between the compression stroke and suction stroke for respectively enlarging and reducing a volume of a pumping chamber, the second piston having a one-way valve for flowing fluid from the pumping chamber to the secondary chamber during the compression stroke;

wherein the one-way valve is closed during the suction stroke to discharge fluid out of the outlet by decreasing a volume of the secondary chamber and the one-way valve is opened during the compression stroke so that collectively the pumping chamber and the secondary chamber reduces in volume to discharge fluid out of the outlet;

wherein the solid shaft between the first and second pistons obstructs fluid flow through the shaft, and the first piston is solid and forms a barrier with the housing to mitigate fluid flow between a tertiary chamber and the secondary chamber.

2. The fluid pump of claim 1 further comprising a spring mounted to the first and second pistons and an electrical coil mounted to the housing for traversing the first and second pistons in the compression and suction strokes.

3. The fluid pump of claim 2 wherein the electrical coil is disposed about the first cavity, and the spring is disposed about the shaft within the first cavity.

4. The fluid pump of claim 1 wherein a diameter of the first piston is smaller than a diameter of the second piston.

5. The fluid pump of claim 1 wherein the pump is a compressor for displacing gas.

6. The fluid pump of claim 1 wherein the fluid is liquid and the pump displaces liquid.

7. The fluid pump of claim 1 further comprising an orifice of the housing for flowing fluid into or out of the tertiary chamber defined by the first piston and the housing.

8. A method of displacing fluid through an outlet of a fluid pump during both a suction stroke and a compression stroke of the fluid pump, the method comprising the steps of:

providing a first piston slideably disposed within a first cavity, a second piston slideably disposed within a second cavity, a linear volumetric displacement of the first cavity being smaller than a linear volumetric displacement of the second cavity, the first piston, the second piston and a housing collectively defining a secondary chamber in fluid communication with the outlet, wherein the first and second pistons are connected to each other with a solid shaft, the solid shaft obstructing fluid flow through the shaft, and the first piston is solid and forms a barrier with the housing to mitigate fluid flow between a tertiary chamber and the secondary chamber;

during a compression stroke, performing the following steps:

opening a one way valve incorporated in the second piston to facilitate flow of fluid between the secondary chamber and a pumping chamber;

reducing a volume collectively defined by the secondary chamber and the pumping chamber to pump fluid out of the secondary chamber through the outlet of the fluid pump;

during a suction stroke, performing the following steps:

closing the one way valve to stop flow of fluid between the secondary chamber and the pumping chamber;

reducing the volume of the secondary chamber to pump fluid out of the secondary chamber through the outlet of the fluid pump.

9. The method of claim 8, wherein the fluid is flowed into and out of the tertiary chamber behind the first piston through the hole of the housing during the compression stroke and the suction stroke.

* * * * *